US009289880B2

(12) United States Patent
Yamada et al.

(10) Patent No.: US 9,289,880 B2
(45) Date of Patent: Mar. 22, 2016

(54) METHOD FOR SETTING SHOT-PEENING PROCESS CONDITION

(75) Inventors: Takeshi Yamada, Nagoya (JP); Akiko Inoue, Nagoya (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 947 days.

(21) Appl. No.: 13/254,760

(22) PCT Filed: Jan. 29, 2010

(86) PCT No.: PCT/JP2010/051202

§ 371 (c)(1), (2), (4) Date: Sep. 20, 2011

(87) PCT Pub. No.: WO2010/100984

PCT Pub. Date: Sep. 10, 2010

(65) Prior Publication Data

US 2012/0017661 A1 Jan. 26, 2012

(30) Foreign Application Priority Data

Mar. 4, 2009 (JP) ..... 2009-050673

(51) Int. Cl.
*B24C 1/10* (2006.01)
*B24C 7/00* (2006.01)
*C21D 7/06* (2006.01)

(52) U.S. Cl.
CPC ..... *B24C 1/10* (2013.01); *B24C 7/0053* (2013.01); *B24C 7/0061* (2013.01); *C21D 7/06* (2013.01)

(58) Field of Classification Search
CPC ..... C21D 7/06; B24C 1/10; B24C 7/0053; B24C 7/0061
USPC ..... 72/53; 29/90.7; 73/11.02
See application file for complete search history.

(56) References Cited

U.S. PATENT DOCUMENTS 2,350,440 A * 6/1944 Almen ..... 73/11.02
2,958,925 A 11/1960 Roberts
3,950,642 A 4/1976 Feld
4,454,740 A * 6/1984 Neal et al. ..... 72/53

(Continued)

FOREIGN PATENT DOCUMENTS

JP 1-210269 8/1989
JP 2003-159651 6/2003

(Continued)

OTHER PUBLICATIONS

Notice of Allowance issued Sep. 10, 2013 in corresponding Chinese Patent Application No. 201080010707.0 with partial English translation.

(Continued)

*Primary Examiner* — Edward Tolan
(74) *Attorney, Agent, or Firm* — Wenderoth, Lind & Ponack, L.L.P.

(57) ABSTRACT

A method for setting a shot-peening process condition includes a step of obtaining, for each of a plurality of peening conditions for a first combination as a combination of a shot peening processing apparatus and media, a saturation time based on a saturation curve indicating a change in an arc height value of an Almen strip against a projection time. The method includes a step of determining a first optimum peening condition corresponding to the first combination based on the saturation time.

24 Claims, 19 Drawing Sheets

(56) References Cited

U.S. PATENT DOCUMENTS

| | | | | |
|---|---|---|---|---|
| 5,172,580 | A * | 12/1992 | Thompson | 72/53 |
| 5,293,320 | A * | 3/1994 | Thompson et al. | 700/160 |
| 5,460,025 | A * | 10/1995 | Champaigne | 72/53 |
| 5,487,543 | A * | 1/1996 | Funk | 473/332 |
| 5,507,172 | A * | 4/1996 | Thompson et al. | 73/11.02 |
| 5,592,840 | A * | 1/1997 | Miyasaka | 72/53 |
| 6,315,646 | B1 | 11/2001 | Hoyashita | |
| 6,319,101 | B1 | 11/2001 | Vago | |
| 6,640,596 | B2 * | 11/2003 | Yamamoto et al. | 72/53 |
| 7,065,479 | B2 * | 6/2006 | Mika et al. | 703/7 |
| 7,159,425 | B2 * | 1/2007 | Prevey et al. | 72/53 |
| 7,300,622 | B2 * | 11/2007 | Lu et al. | 266/249 |
| 7,458,881 | B2 * | 12/2008 | Kawashima et al. | 451/66 |
| 2003/0005736 | A1 | 1/2003 | Inoue et al. | |
| 2005/0204528 | A1 * | 9/2005 | Culp et al. | 29/90.7 |
| 2010/0011826 | A1 * | 1/2010 | Buehler et al. | 72/42 |

FOREIGN PATENT DOCUMENTS

| | | |
|---|---|---|
| JP | 2004-142007 | 5/2004 |
| JP | 2006-205342 | 8/2006 |
| TW | 400267 | 8/2000 |
| TW | 414738 | 12/2000 |
| TW | 544376 | 8/2003 |

OTHER PUBLICATIONS

Taiwanese Office Action issued Aug. 30, 2013 in corresponding Taiwanese Patent Application No. 99102660 with partial English translation.

Japanese Decision to Grant a Patent issued Jul. 31, 2012 in corresponding Japanese Patent Application No. 2009-050673 with English translation.

Taiwanese Notice of Allowance issued Jan. 22, 2014 in corresponding Taiwanese Patent Application No. 099102660 with English translation.

International Search Report issued Apr. 27, 2010 in International (PCT) Application No. PCT/JP2010/051202.

Extended European Search Report issued Nov. 27, 2014 in corresponding European Patent Application No. 10748581.5.

Decision to grant a European patent pursuant to Article 97(1) EPC issued Jan. 8, 2016 in corresponding European Application No. 10748581.5.

* cited by examiner

Fig. 6

| CONDITION NUMBER | 1-1 | 1-2 | 1-3 |
|---|---|---|---|
| AIR PRESSURE P [MPa] | 0.3 | 0.3 | 0.3 |
| ANGLE $\theta$ | 90 | 90 | 90 |
| FLOW RATE kg/min | 1.3 | 4 | 7 |
| MEDIA | S70 | S70 | S70 |
| DISTANCE/mm | 200 | 200 | 200 |
| NOZZLE DIAMETER | 9 | 9 | 9 |

Fig. 17

| CONDITION NUMBER | 1-4 | 1-5 | 1-6 |
|---|---|---|---|
| AIR PRESSURE P [MPa] | 0.3 | 0.3 | 0.2 |
| ANGLE $\theta$ | 90 | 90 | 90 |
| FLOW RATE kg/min | 3 | 5 | 4 |
| MEDIA | S70 | S70 | S70 |
| DISTANCE/mm | 200 | 200 | 200 |
| NOZZLE DIAMETER | 9 | 9 | 9 |

METHOD FOR SETTING SHOT-PEENING PROCESS CONDITION

TECHNICAL FIELD

The present invention relates to a shot peening processing method.

BACKGROUND ART

A shot peening processing method is used to provide a metal surface layer with compressive residual stress. In the shot peening processing method, media (shot media) is projected onto a work.

In a conventional shot peening processing method, after a combination of a shot peening processing apparatus and media is determined, a process condition is determined such that intensity and coverage required for a work can be achieved. An effective and systematic method for reducing a required time for shot peening process is required.

Japanese Patent Publication (JP-P2006-205342A) discloses a conventional method for setting shot peening condition. A relation between weight of shot media projected per unit time and an arc height value when coverage is 100% is obtained by using an air blast type shot-peening apparatus. When the weight of shot media projected per unit time is greater than a certain value, the arc height value is greatly reduced as the weight of shot media projected per unit time is increased. Based on the value, an optimum value of weight of shot media projected per unit time is set.

SUMMARY OF INVENTION

An objective of the present invention is to provide a method for setting shot-peening process condition and a method for manufacturing metal part which reduce required time for shot-peening process.

In a first aspect of the present invention, a method for setting shot-peening process condition includes: a step of obtaining, for each of a plurality of peening conditions for a first combination as a combination of a shot-peening processing apparatus and media, a saturation time based on a saturation curve indicating change in arc height value of Almen strip against projection time; and a step of determining a first optimum peening condition corresponding to the first combination based on the saturation time.

Preferably, condition factors of the plurality of peening conditions include a first condition factor and a second condition factor. The plurality of peening conditions include: a first peening condition; a second peening condition different from the first peening condition in only a level of the first condition factor; a third peening condition; and a fourth peening condition different from the third peening condition in only a level of the second condition factor. The step of determining the first optimum peening condition based on the saturation time includes: a step of determining a level of the first condition factor in the first optimum peening condition based on a first saturation time under the first peening condition and a second saturation time under the second peening condition; and a step of determining a level of the second condition factor in the first optimum peening condition based on a third saturation time under the third peening condition and a fourth saturation time under the fourth peening condition.

Preferably, the shot-peening processing apparatus projects media from a nozzle by using air. The first condition factor and the second condition factor are arbitrary two selected from flow rate of media, pressure of air, distance between the nozzle and a surface to be processed, angle between the nozzle and a surface to be processed, inner diameter of the nozzle, and movement speed of the nozzle.

Preferably, the shot-peening processing apparatus projects media by using an impeller. The first condition factor and the second condition factor are arbitrary two selected from rotation speed of the impeller, distance between the impeller and a surface to be processed, angle between the impeller and a surface to be processed, size of a projection outlet, movement speed of a work, and rotation speed of a work.

Preferably, the above method for setting shot-peening process condition includes: a step of the shot-peening processing apparatus projecting media to a test piece under the first optimum peening condition; a step of obtaining a relation between a distribution of dimpled area ratio in the test piece and projection time; and a step of obtaining, based on the relation between the distribution of the dimpled area ratio and the projection time, a relation between area or width of a region of the test piece, in which the dimpled area ratio is saturated, and the projection time. The dimpled area ratio indicates an area occupied by dimples formed by media per unit area.

Preferably, the above method for setting shot-peening process condition further includes a step of determining a spot movement condition based on the relation between the area or width and the projection time. The spot movement condition indicates a pitch of movement trajectories along which a spot moves. The movement trajectories are parallel to each other. The spot is a region of a work, which is hit by media when the shot-peening processing apparatus processes the work.

Preferably, when intensity corresponding to the first optimum peening condition does not match intensity required for a work, the above method for setting shot-peening process condition further includes: a step of obtaining a saturation time for each of a plurality of peening conditions for a second combination as a combination of a shot-peening processing apparatus and media; and a step of determining a second optimum peening condition corresponding to the second combination based on the saturation time corresponding to the second combination.

Preferably, the above method for setting shot-peening process condition further includes a step of obtaining intensity under the first optimum peening condition.

Preferably, the above method for setting shot-peening process condition further includes: a step of obtaining a coverage time as a projection time required for a coverage of 100% for each of the plurality of peening conditions by using the Almen strip used in the step of obtaining the saturation time; a step of determining a third optimum peening condition corresponding to the first combination based on the coverage time; and a step of determining a fourth peening condition based on the first peening condition and the third peening condition.

In a second aspect of the present invention, a method for setting shot-peening process condition includes: a step of a shot-peening processing apparatus projecting media onto a test piece; a step of obtaining a relation between a distribution of dimpled area ratio in the test piece and projection time; and a step of obtaining, based on the relation between the distribution of the dimpled area ratio and the projection time, a relation between area or width of a region of the test piece, in which the dimpled area ratio is saturated, and the projection time. The dimpled area ratio indicates area occupied by dimples formed by media per unit area.

In a third aspect of the present invention, a method for setting shot-peening process condition includes: a step of obtaining, for each of a plurality of peening conditions for a first combination as a combination of a shot-peening processing apparatus and media, a coverage time as a projection time required for a coverage of 100% based on a saturation curve indicating change in coverage of Almen strip against projection time; and a step of determining an optimum peening condition corresponding to the first combination based on the coverage time.

Preferably, condition factors of the plurality of peening conditions include a first condition factor; and a second condition factor. The plurality of peening conditions include: a first peening condition; a second peening condition different from the first peening condition in only a level of the first condition factor; a third peening condition; and a fourth peening condition different from the third peening condition in only a level of the second condition factor. The step of determining the optimum peening condition based on the coverage time includes: a step of determining a level of the first condition factor in the optimum peening condition based on a first coverage time under the first peening condition and a second coverage time under the second peening condition; and a step of determining a level of the second condition factor in the optimum peening condition based on a third coverage time under the third peening condition and a fourth coverage time under the fourth peening condition.

In a fourth aspect of the present invention, a method for manufacturing metal part includes: a step of determining a shot-peening process condition; and a step of processing a work based on the shot-peening process condition. The step of determining the shot-peening process condition includes: a step of obtaining, for each of a plurality of peening conditions for a first combination as a combination of a shot-peening processing apparatus and media, a saturation time based on a saturation curve indicating change in arc height value of Almen strip against projection time; and a step of determining a first optimum peening condition corresponding to the first combination based on the saturation time.

In a fifth aspect of the present invention, a method for manufacturing metal part includes: a step of determining a shot-peening process condition; and a step of processing a work based on the shot-peening process condition. The step of determining the shot-peening process condition includes: a step of a shot-peening processing apparatus projecting media onto a test piece; a step of obtaining a relation between a distribution of dimpled area ratio in the test piece and projection time; a step of obtaining, based on the relation between the distribution of the dimpled area ratio and the projection time, a relation between area or width of a region of the test piece, in which the dimpled area ratio is saturated, and the projection time; and a step of determining a spot movement condition based on the relation between the area or width and the projection time. The spot movement condition indicates a movement condition of a spot as a region of the work, which is hit by media when the shot-peening apparatus processes the work.

In a sixth aspect of the present invention, a method for manufacturing metal part includes: a step of determining a shot-peening process condition; and a step of processing a work based on the shot-peening process condition. The step of determining the shot-peening process condition includes: a step of obtaining, for each of a plurality of peening conditions for a first combination as a combination of a shot-peening processing apparatus and media, a coverage time as a projection time required for a coverage of 100% based on a saturation curve indicating change in coverage of Almen strip against projection time; and a step of determining an optimum peening condition corresponding to the first combination based on the coverage time.

According to the present invention, there are provided a method for setting shot-peening process condition and a method for manufacturing metal part which reduce required time for shot-peening process.

BRIEF DESCRIPTION OF DRAWINGS

The above and other objects, advantages, and features of the present invention will be more apparent from the description of embodiments taken in conjunction with the accompanying drawings, in which:

FIG. 6 is a table showing peening conditions;

FIG. 17 is a table showing peening conditions;

DESCRIPTION OF EMBODIMENTS

With reference to the accompanying drawings, embodiments of a method for setting shot-peening process condition and a shot-peening processing method according to the present invention will be described below.

First Embodiment

Figure 1:
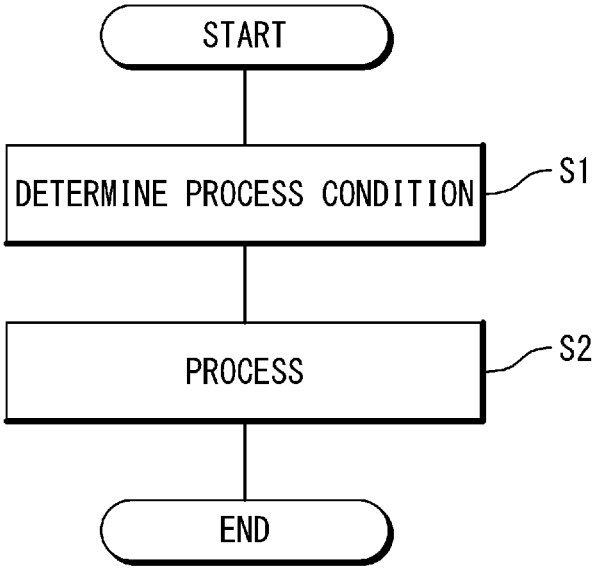
FIG. 1 is a flow chart of a shot-peening processing method according to a first embodiment of the present invention.

FIG. 1 is a flow chart of a shot-peening processing method according to a first embodiment of the present invention. The shot-peening processing method includes a step S1 and a step S2. In the step S1, a shot-peening process condition is determined. In the step S2, a work is processed based on the condition determined in the step S1.

Figure 2:
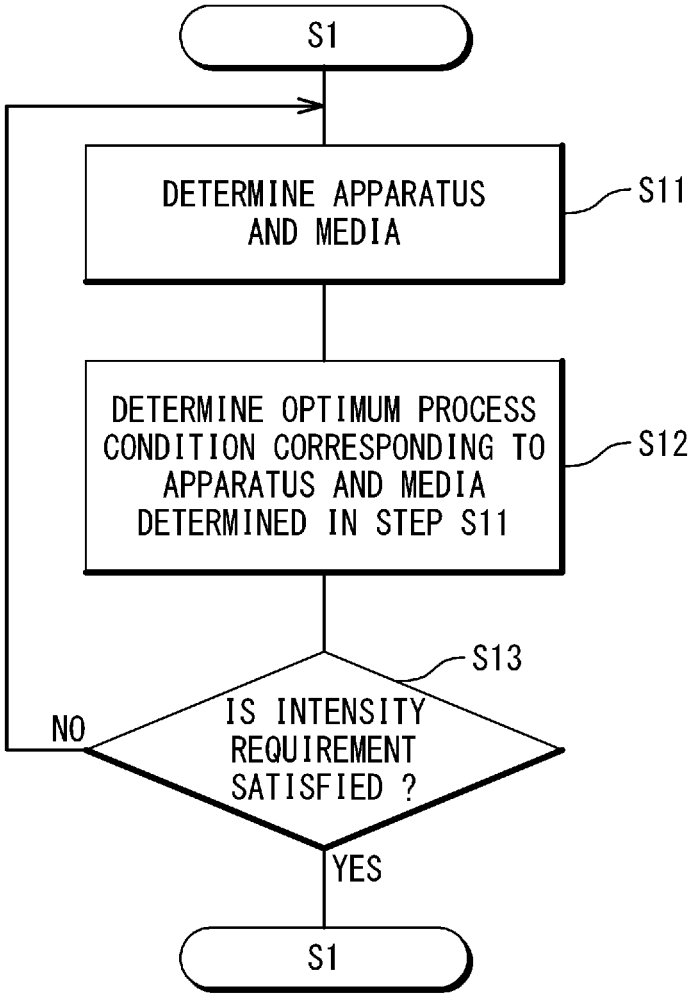
FIG. 2 is a flow chart of a step of determining a shot-peening process condition.

With reference to FIG. 2, the step S1 of determining shot-peening process condition includes steps S11 to S13. In the step S11, a combination of a shot-peening processing apparatus and media is determined. Here, a shot-peening processing apparatus as an assessment target is determined concretely, for example, by specifying a model of an air blast type shot-peening processing apparatus or a model of a mechanical type shot-peening processing apparatus. The air blast type shot-peening processing apparatus projects media from a nozzle by using air. The mechanical type shot-peening apparatus projects media by using an impeller. Then, media is determined from a plurality kinds of media which can be used by the determined shot-peening processing apparatus and are controlled based on certain quality standard. By using media controlled based on certain quality standard, reproducibility of shot-peening process is secured. The media controlled based on certain quality standard is, for example, media specified by public standard. In the step S12, an optimum process condition corresponding to the combination determined in the step S11 is determined. In the step S13, it is judged whether an intensity required for a work is satisfied, when the work is processed by using the shot-peening processing apparatus and the media determined in the step S11 based on the optimum process condition determined in the step S12. When the intensity requirement is not satisfied, the method returns to the step S11. When the intensity requirement is satisfied, the method proceeds to the step S2.

Figure 3:
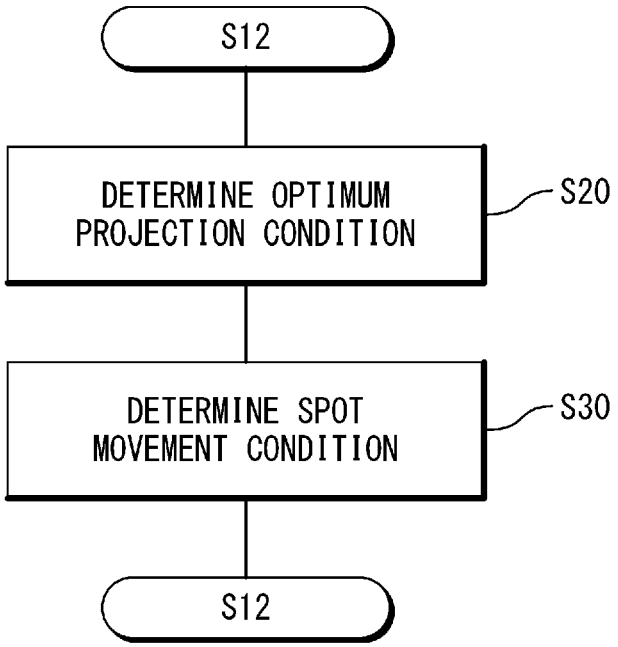
FIG. 3 is a flow chart of a step of determining an optimum process condition which corresponds to a combination of an apparatus and media.

With reference to FIG. 3, the step S12 of determining an optimum process condition includes steps S20 and S30. In the step S20, an optimum process condition is determined for a case that the shot-peening processing apparatus determined in the step S11 projects the media determined in the step S11. In the step S30, a spot movement condition is determined. The spot movement condition indicates a movement condition of a spot as a region of a work which is hit by the media when the shot-peening processing apparatus determined in the step S11 processes the work.

Figure 4:
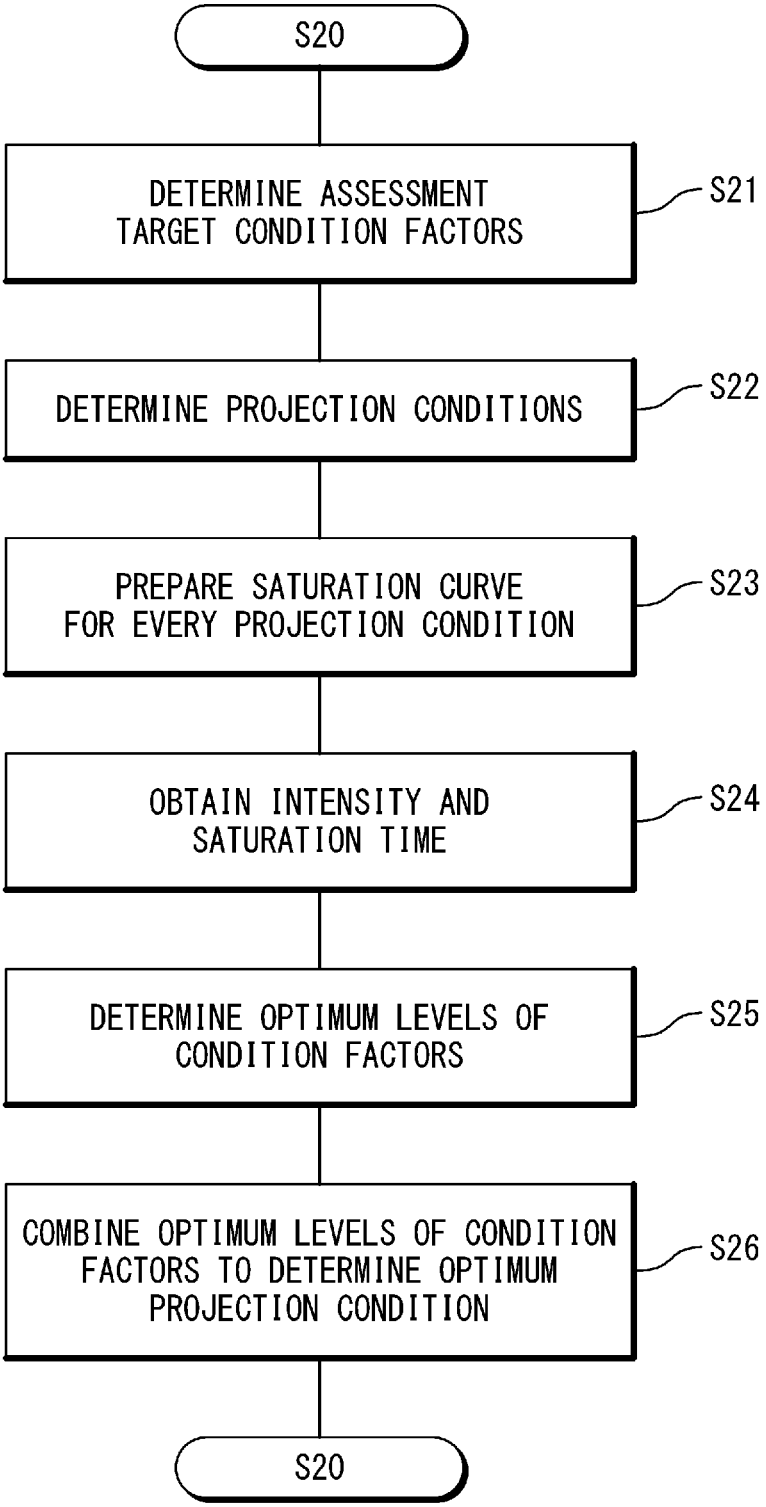
FIG. 4 is a flow chart of a step of determining an optimum peening condition.

With reference to FIG. 4, the step S20 of determining an optimum process condition includes steps S21 to S26.

In the step S21, assessment target condition factors are determined. For example, assessment target condition factors in a case of an air blast type shot-peening processing apparatus are: flow rate (kg/min) of media; air pressure (MPa); distance (projection distance) between a nozzle as a projection unit of the air blast type shot-peening processing apparatus and a surface of a work; angle (projection angle) between the nozzle and the work surface; inner diameter of the nozzle; and movement speed of the nozzle. For example, assessment target condition factors in a case of a mechanical type shot-peening processing apparatus are: rotation speed (rpm) of an impeller as a projection unit of the mechanical type shot-peening processing apparatus; distance (projection distance) between the impeller and a surface of a work; angle (projection angle) between the impeller and the work surface; size of a projection outlet from which the media is injected to the work surface; movement speed of the work; and rotation speed (rpm) of the work.

Figure 5:
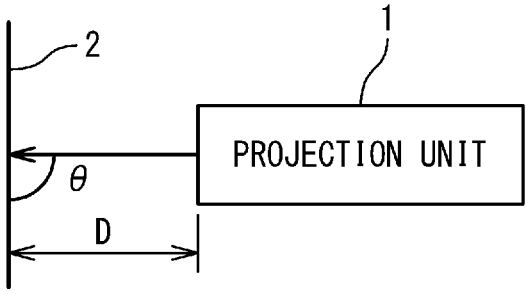
FIG. 5 is a schematic diagram showing a positional relation between a projection unit of a shot-peening processing apparatus and a surface of a working piece.

With reference to FIG. 5, there are shown a distance D between the projection unit 1 of the shot-peening processing apparatus and the work surface 2, and the angle • between the projection unit 1 and the work surface 2.

In the step S22, a plurality of peening conditions is determined. For example, condition factors of the plurality of peening conditions include the flow rate, the pressure, the angle, the distance and the like as the condition factors determined in the step S21. FIG. 6 shows peening conditions 1-1 to 1-3 included in the plurality of peening conditions. The peening conditions 1-1 to 1-3 are different from each other in only the level of the flow rate but are the same in levels of the other condition factors. The plurality of peening conditions includes a peening condition group in which only the level of the pressure is different, a peening condition group in which only the level of the angle is different, a peening condition group in which only the level of the distance is different, and the like.

Figure 7:
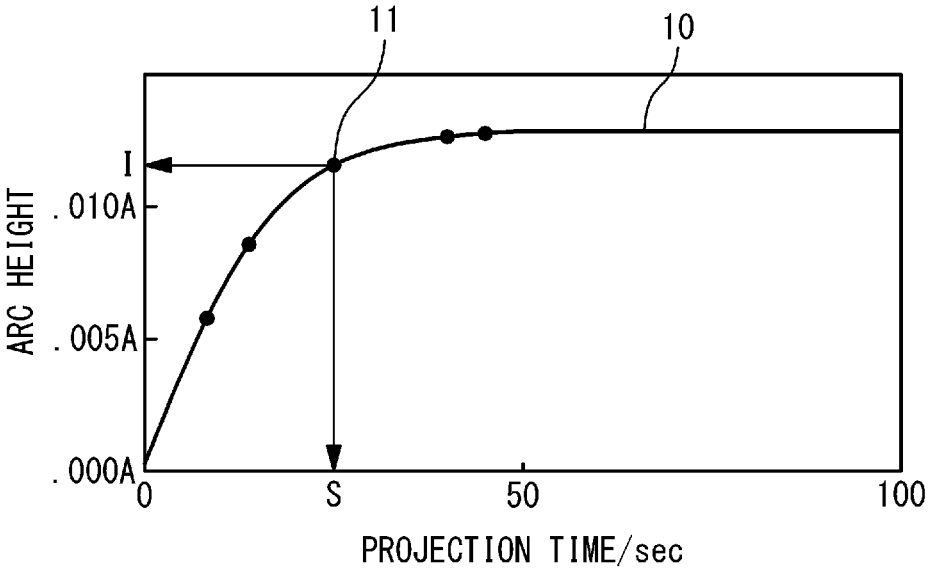
FIG. 7 is a graph showing a relation between arc height and projection time.

In the step S23, a saturation curve indicating change in arc height value of Almen strip against projection time is prepared for each of the plurality of peening conditions determined in the step S22. FIG. 7 shows a saturation curve 10 obtained based on arc height values when projection time is 5 seconds, 10 seconds, 20 seconds, and 40 seconds under a certain peening condition.

In the step S24, intensity and saturation time for each of the peening conditions determined in the step S22 are obtained based on the saturation curves obtained in the step S23. With reference to FIG. 7, a method for obtaining intensity and saturation time will be described. According to AMS-S-13165A of National Aerospace Standard, a point 11 on the saturation curve 10, for which increase in the arc height value is 10% or below when the projection time is doubled, is referred to as a saturation point 11, the arc height value at the saturation point 11 is intensity I, and the projection time at the saturation point 11 is saturation time S.

Figure 8A:
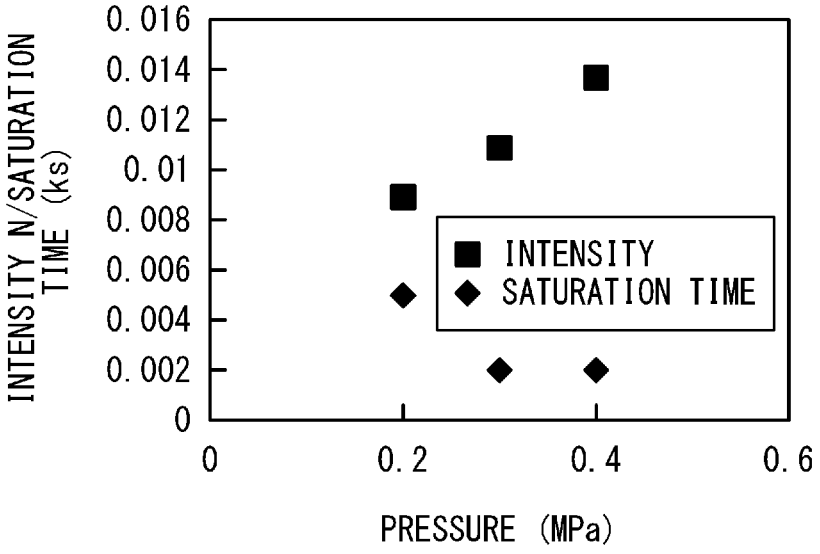
FIG. 8A is a graph showing a relation between intensity and pressure and a relation between saturation time and pressure.
Figure 8B:
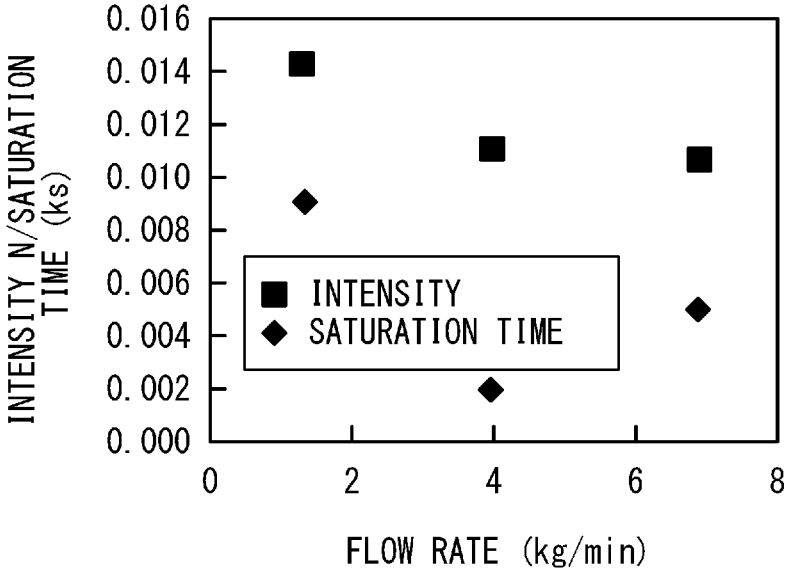
FIG. 8B is a graph showing a relation between intensity and media flow rate and a relation between saturation time and media flow rate.
Figure 8C:
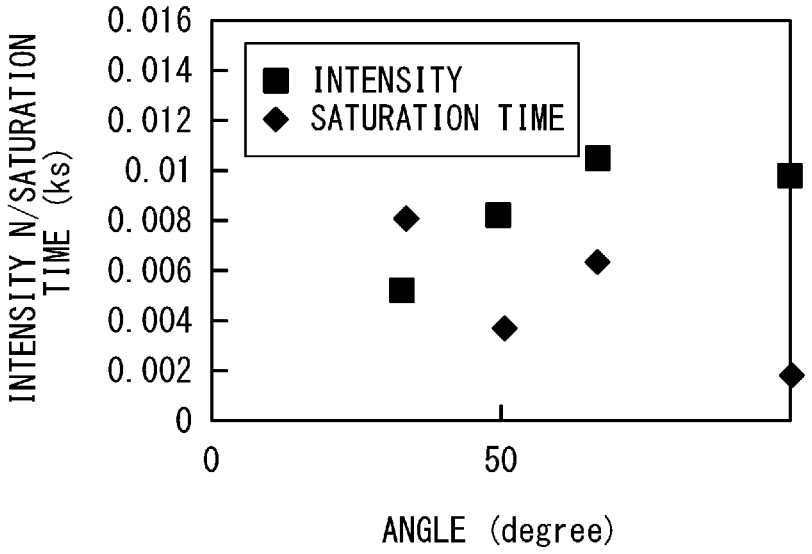
FIG. 8C is a graph showing a relation between intensity and projection angle and a relation between saturation time and projection angle.
Figure 8D:
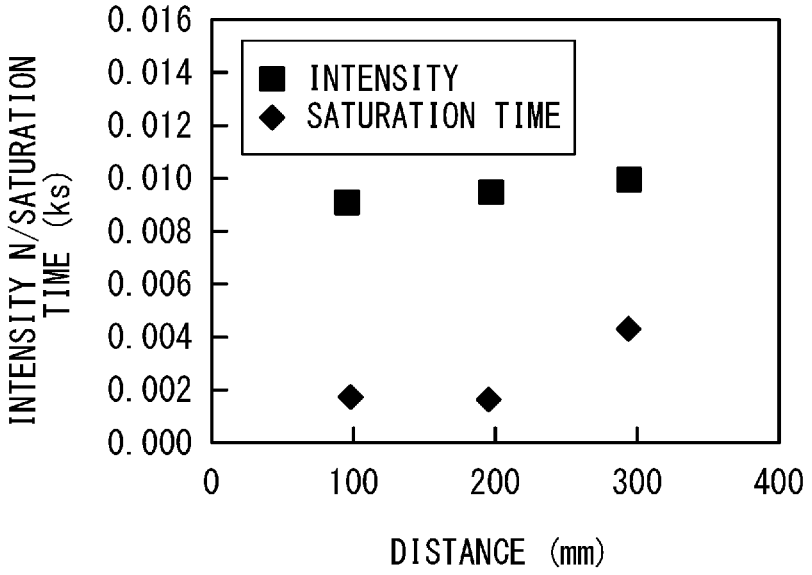
FIG. 8D is a graph showing a relation between intensity and projection distance and a relation between saturation time and projection distance.

In the step S25, an optimum level of each condition factor is determined such that the shortest saturation time is attained. For example, FIG. 8A shows a relation between intensity and pressure and a relation between saturation time and pressure, which are obtained as described above. Based on the relation between saturation time and pressure, the optimum level of pressure is determined to be 0.3 MPa or above. FIG. 8B shows a relation between intensity and flow rate and a relation between saturation time and flow rate, which are obtained as described above. Based on the relation between saturation time and flow rate, the optimum level of flow rate is determined to be 4 kg/min. FIG. 8C shows a relation between intensity and angle and a relation between saturation time and angle, which are obtained as described above. Based on the relation between saturation time and angle, the optimum level of angle is determined to be 90 degrees. FIG. 8D shows a relation between intensity and distance and a relation between saturation time and distance, which are obtained as described above. Based on the relation between saturation time and distance, the optimum level of distance is determined to be 200 mm or shorter.

In the step S26, an optimum peening condition corresponding to the combination of the shot-peening processing apparatus and the media determined in the step S11 is determined. The optimum peening condition is a combination of the optimum levels of the respective condition factors, which are determined in the step S25.

The peening condition 1-2 shown in FIG. 6 corresponds to the optimum peening condition determined in the step S26. Therefore, intensity under the optimum peening condition is obtained from FIG. 8B. Therefore, the intensity which can be obtained effectively (in a short processing time) by using the combination of the shot-peening apparatus and the media determined in the step S11 is 0.011 inch N from FIG. 8B. Note that it is also possible to obtain intensity under the optimum peening condition by conducting new tests.

After the step S26, the method proceeds to the step S30.

As mentioned above, based on the saturation time, the optimum peening condition is determined under which a processing time is short in processing with the use of the combination determined in the step S11. In general, it is considered that coverage time required for the coverage of 100% is shorter as the saturation time is shorter. The saturation time is easily determined as compared to the coverage time.

By optimizing the spot movement condition, the processing time can further be reduced. The step S30 of determining a spot movement condition will be described below.

Figure 9:
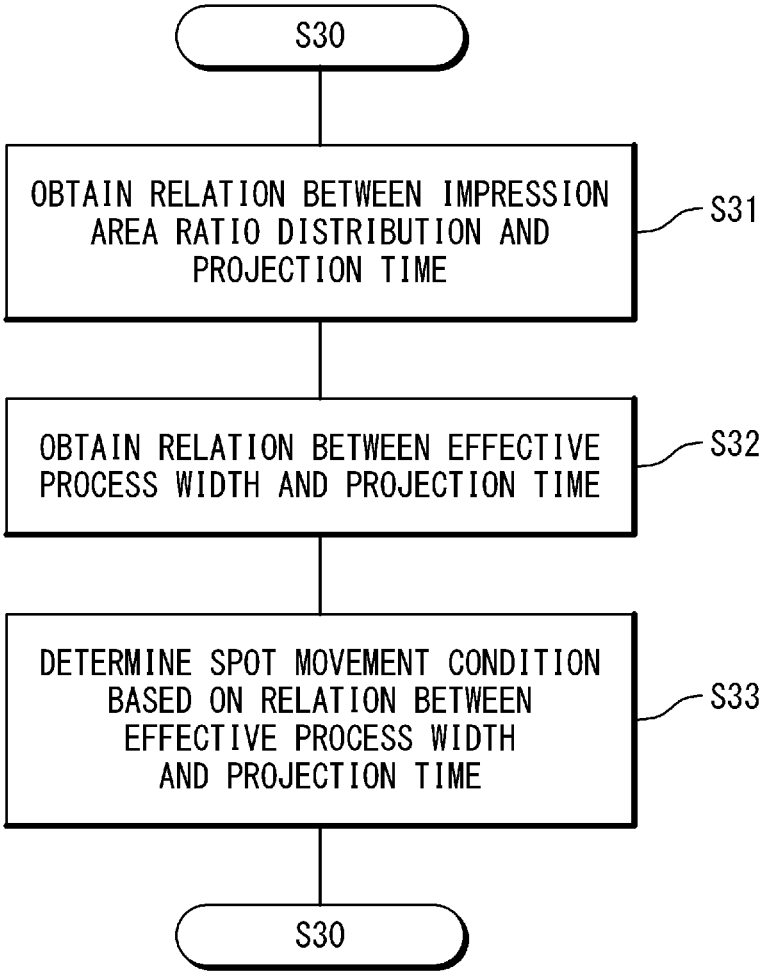
FIG. 9 is a flow chart of a step of determining a spot movement condition.

With reference to FIG. 9, the step S30 includes steps S31 to S33.

Figure 10:
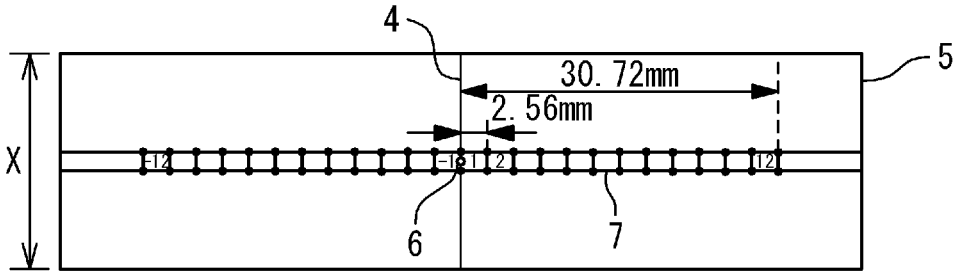
FIG. 10 shows a test piece for obtaining a relation between dimpled area ratio distribution and projection time.

The step S31 will be described. FIG. 10 shows a test piece 5 used in the step S31. The test piece 5 is an Almen strip or a plate made of the same material as the work. It is preferable that the test piece 5 should be sufficiently larger compared with an effective process width (area) which will be mentioned later. In the step S31, the shot-peening processing apparatus determined in the step S11 projects the media determined in the step S11 onto the test piece 5 under the optimum peening condition determined in the step S20. At this time, approximately three levels of projection time are set within a range including the saturation time under the optimum peening condition, for example. Here, the projection unit of the shot-peening processing apparatus and the test piece 5 may relatively move under a predetermined condition. In this case, for example, the projection unit moves parallel or swings such that a spot as a region which is hit by the media moves forward and backward along a center line 4 of the test piece 5. The length of the test piece 5 in the direction of the center line 4 is X.

In the step S31, the surface of the test piece 5, onto which the projection is performed, is observed by using a magnifying glass, and dimpled area ratio is calculated for each of a plurality of area ratio calculation regions 7 defined on the surface of the test piece 5. The plurality of area ratio calculation regions 7 are arranged on the both sides of the center line 4 of the test piece 5 along a straight line crossing the center line 4 at a center position 6. The plurality of area ratio calculation regions 7 are regions of the same shape and the same size. Each area ratio calculation region 7 is a rectangular region of 2.56 mm square, for example. Numbers indicating measurement locations of the area ratio calculation regions 7 are shown in the figure. The absolute value of the number is greater as the location is farther from the center position 6. The sign of the number is positive when the measurement location is in one side of the center line 4 or negative when the measurement location is in the other side of the center line 4. The dimpled area ratio indicates area occupied by impressions (dimples) formed by the media per unit area.

Figure 11:
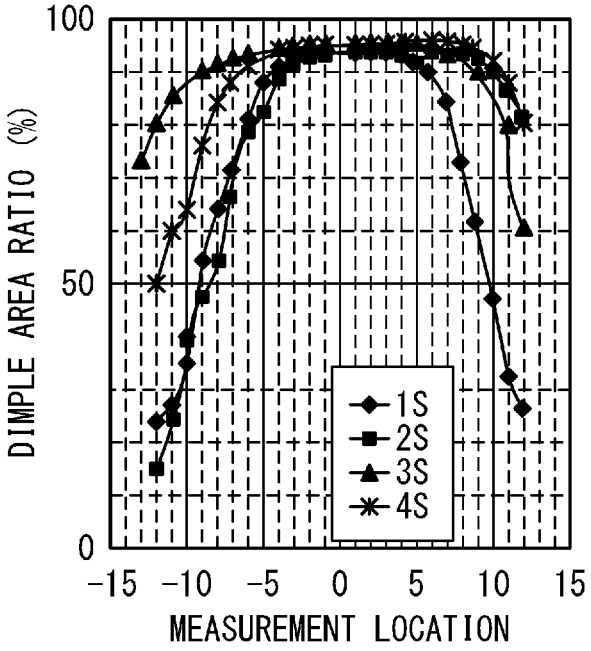
FIG. 11 is a graph showing a relation between dimpled area ratio distribution and projection time.

In the step S31, a relation between dimpled area ratio distribution in the test piece 5 and projection time is obtained. FIG. 11 shows the relation between dimpled area ratio distribution in the test piece 5 and projection time. The vertical axis and horizontal axis of FIG. 11 are dimpled area ratio and measurement location on the test piece 5, respectively. In FIG. 11, for each projection time of 1, 2, 3 and 4 seconds, a relation between dimpled area ratio and measurement location is shown.

Figure 12:
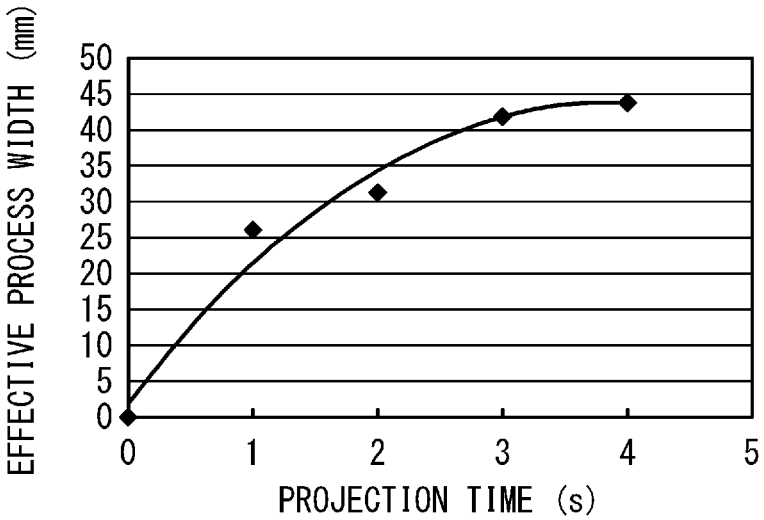
FIG. 12 is a graph showing a relation between effective process width and projection time.

In the step S32, based on the relation between dimpled area ratio distribution and projection time shown in FIG. 11, for each projection time of 1, 2, 3 and 4 seconds, a width of a region of the test piece 5, in which the dimpled area ratio is saturated. The region in which the dimpled area ratio is saturated is a region in which the coverage comes up to 100% or more. The width of the region in which the dimpled area ratio is saturated is referred to as an effective process width. It is also possible to use the area (effective process area) of the region in place of the effective process width. FIG. 12 shows a relation between effective process width and projection time. The vertical axis and horizontal axis of FIG. 12 are effective process width and projection time, respectively. Although the effective process width is increased as the projection time is increased, increase in the effective process width is slower when the projection time exceeds 1 second.

Figure 13:
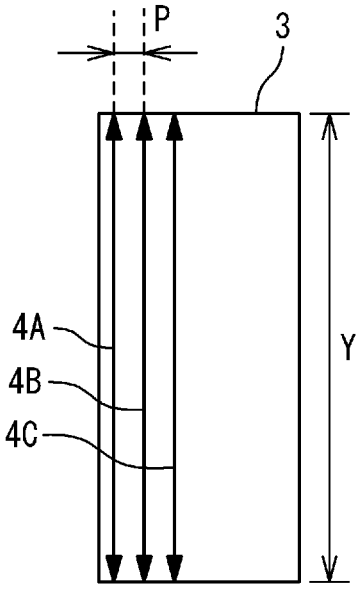
FIG. 13 is a schematic diagram showing spot movement trajectories.

In the step S33, a spot movement condition is determined based on the relation between effective process width and projection time of FIG. 12. With reference to FIG. 13, when the shot-peening processing apparatus determined in the step S11 processes the work 3, a spot as a region of the work 3, which is hit by the media, is moved forward and backward along each of movement trajectories 4A to 4C. The movement trajectories 4A to 4C are parallel to each other. Here, a length of the work 3 in the direction of the movement trajectories 4A to 4C is Y, and a pitch of the movement trajectories 4A to 4C is P. The pitch P is a distance between adjacent two of the movement trajectories 4A to 4C. Since the effective process width is 25 mm when the projection time is 1 second in FIG. 12, the spot movement condition is determined as follows: the pitch P is 25 mm; and projection time for moving the spot forward and backward along each of the movement trajectories 4A to 4C is (Y/X) times 1 second.

Figure 14:
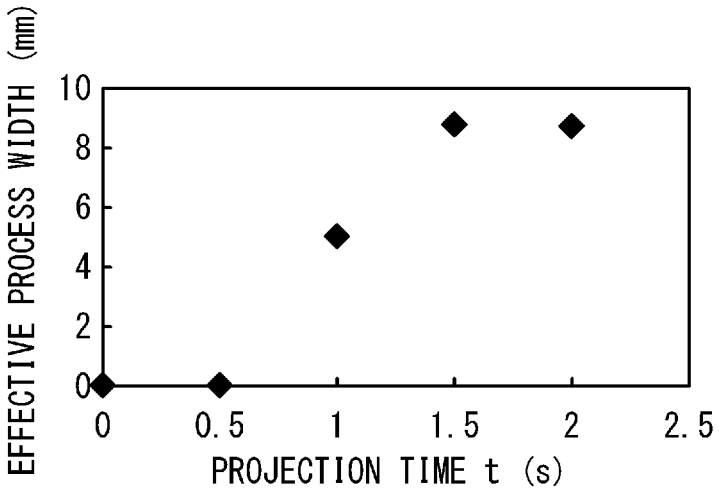
FIG. 14 is a graph showing a relation between effective process width and projection time.
Figure 15:
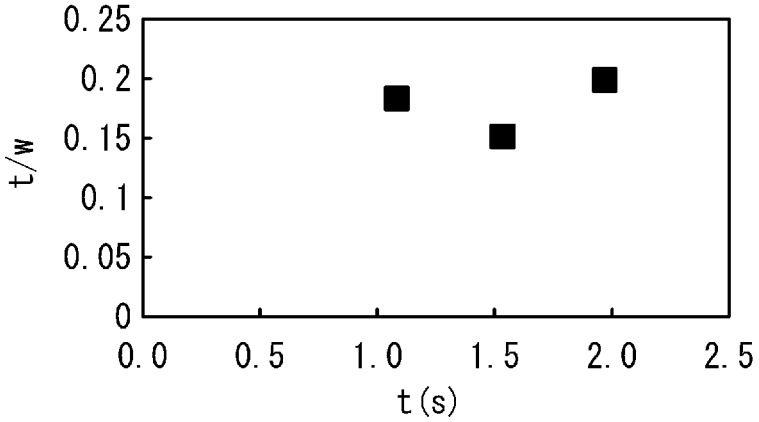
FIG. 15 is a graph showing a relation between processing time per unit area and projection time.

Another example of the step S30 will be described. FIG. 14 shows another example of a relation between effective process width w and projection time t. When the projection time t is given, coverage is 100% or more in a rectangular region with a length of X and a width of w. That is to say, area Xw is processed in time t. Since the length X is a constant, processing time per unit area is proportional to t/w. FIG. 15 shows a relation between t/w and t obtained from the relation between effective process width w and projection time t of FIG. 14. In this case, based on 1.5 seconds as the value of t at which the value of t/w is the smallest and the effective process width of 9 mm in this case, the spot movement condition is determined as follows: the pitch P is 9 mm; and projection time for moving the spot forward and backward along each of the movement trajectories 4A to 4C is (Y/X) times 1.5 seconds.

When a work to be processed has concretely been determined, it is preferable that the step S13 should be performed after the step S20 and before the step S30.

In the step S20, it is also possible to fix a level of a specific condition factor and then determine optimum levels of the other condition factors. For example, when projection onto the entire of the surface of work is impossible with the projection angle of 90 degrees due to many convexes and concaves of the surface of the work, the projection angle is fixed at 45 degrees and then optimum levels of the other condition factors are determined.

Second Embodiment

A method for setting shot-peening process condition according to a second embodiment of the present invention is the same as the method for setting shot-peening process condition according to the first embodiment except for a point that the step S20 is replaced by a step S210 of determining optimum peening condition.

Figure 16:
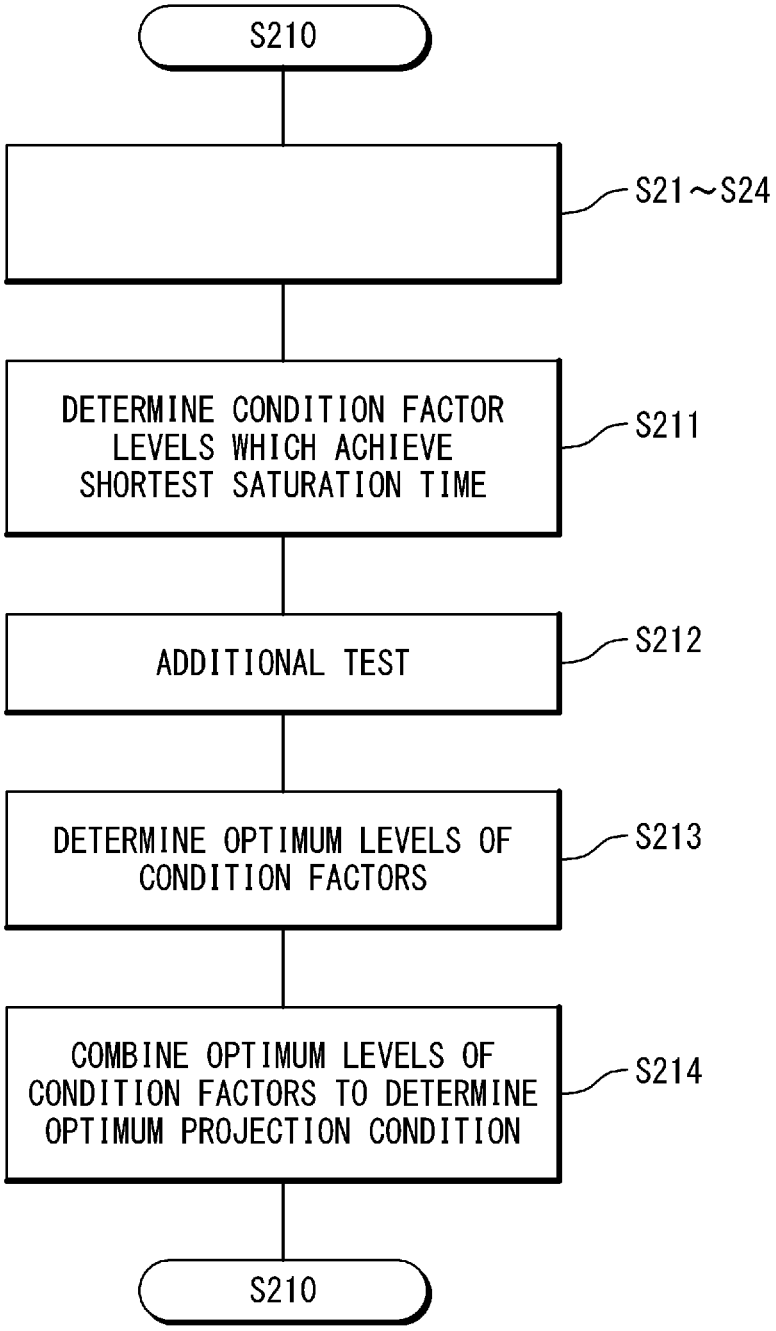
FIG. 16 is a flow chart of a step of determining an optimum peening condition according to a second embodiment of the present invention.

As shown in FIG. 16, the step S210 includes the above-described steps S21 to S24 and steps S211 to S214. In the step S211, in the same way as the step S25, an optimum level of each condition factor is determined such that the shortest saturation time is attained. In the step S212, additional tests are performed for the vicinity of the levels judged in the step S211.

FIG. 17 shows examples of peening conditions in the additional tests. A peening condition 1-4 is the same as the peening condition 1-2 except for a point that the flow rate is 3 kg/min. A peening condition 1-5 is the same as the peening condition 1-2 except for a point that the flow rate is 5 kg/min. A peening condition 1-6 is the same as the peening condition 1-2 except for a point that the pressure is 0.2 MPa. Intensity and saturation time are obtained for each peening condition.

In the step S213, based on the saturation times obtained in the step S212 and the saturation times obtained in the step S24, optimum levels of the respective condition factors are determined.

In the step S214, an optimum peening condition corresponding to the combination of the shot-peening processing apparatus and the media determined in the step S11 is determined. The optimum peening condition is a combination of the optimum levels of condition factors determined in the step S213.

Third Embodiment

A method for setting shot-peening process condition according to a third embodiment of the present invention is the same as the method for setting shot-peening process condition according to the first or second embodiment except for points that the step S20 is replaced by a step S220 and the step S30 is eliminated.

Figure 18:
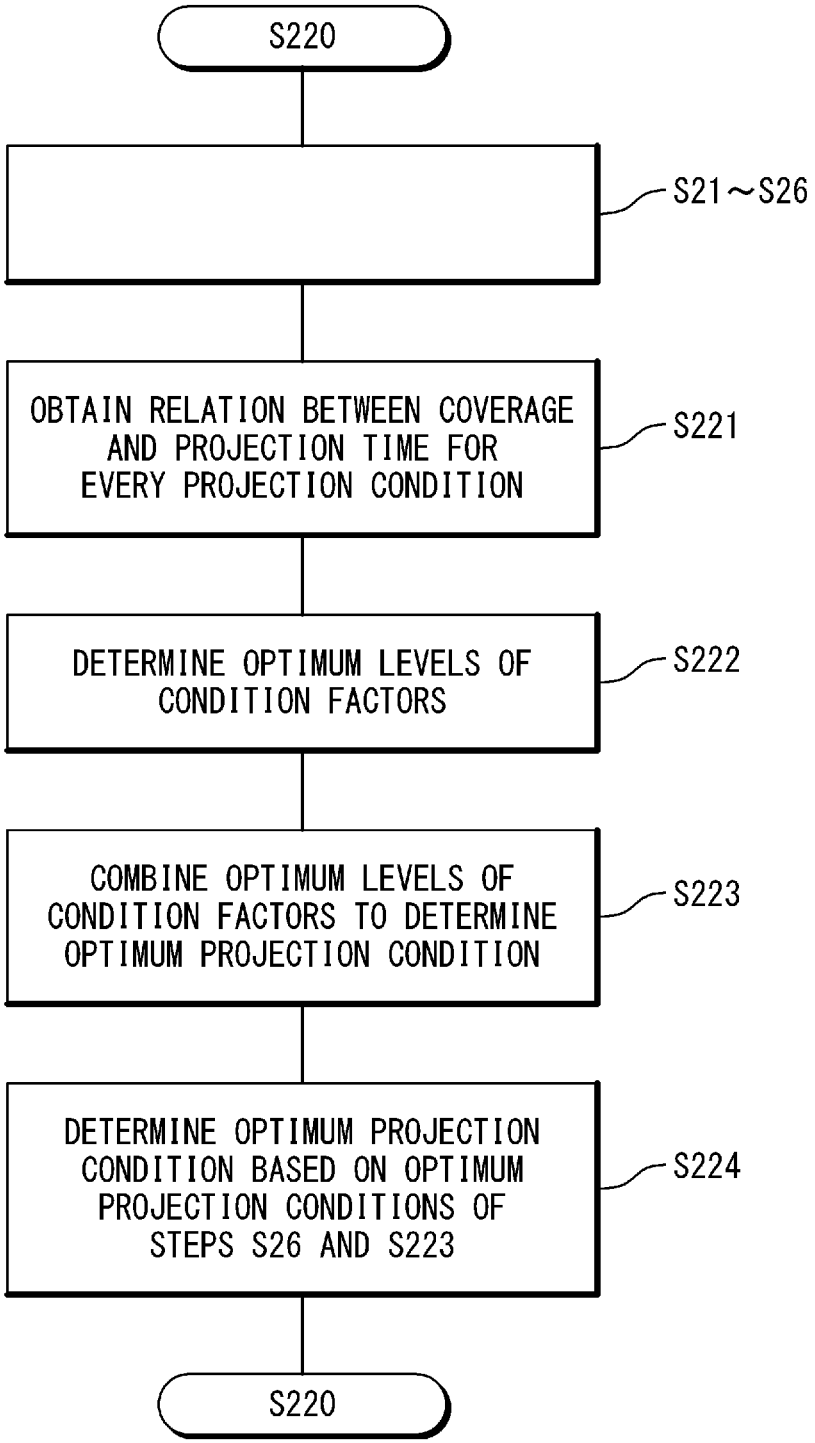
FIG. 18 is a flow chart of a step of determining an optimum peening condition according to a third embodiment of the present invention.
Figure 19:
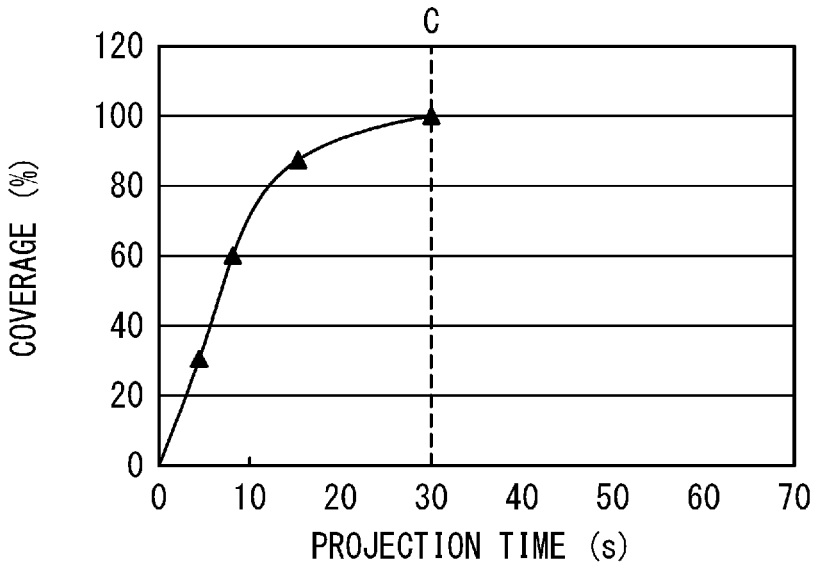
FIG. 19 is a graph showing a relation between coverage and projection time.

With reference to FIG. 18, the step S220 includes the above-described steps S21 to S26 and steps S221 to S224. In the step S221, by using the Almen strips used in the step S23, under each of the plurality of peening conditions, a relation between coverage of the entire surface of the Almen strip and projection time is obtained. The coverage is determined based on comparison between photographs for coverage judgment as seen in the appendix of JIS B 2711 and the surface of the Almen strip, for example. Then, for each peening condition, a saturation curve indicating change in coverage against projection time as shown in FIG. 19 is obtained. The vertical axis and horizontal axis of FIG. 19 are coverage and projection time, respectively. Based on the saturation curve, coverage time C as projection time required for the coverage of 100% is obtained. In this way, coverage time is obtained for each of the plurality of peening conditions.

In the step S222, optimum levels of the respective condition factors are determined such that the shortest coverage time is attained.

In the step S223, an optimum peening condition corresponding to the combination of the shot-peening processing apparatus and the media determined in the step S11 is determined. The optimum peening condition is a combination of the optimum levels of condition factors determined in the step S222.

In the step S224, an optimum peening condition is determined based on the optimum peening condition determined in the step S26 and the optimum peening condition determined in the step S223. For example, the optimum peening condition of the step S224 may be determined by selecting one of the optimum peening condition determined in the step S26 and the optimum peening condition determined in the step S223, or the optimum peening condition of the step S224 may be determined by modifying the optimum peening condition determined in the step S26 based on the optimum peening condition determined in the step S223.

In the present embodiment, the work is processed in the step S2 based on the optimum peening condition determined in the step S224.

There is a possibility that the coverage time under the optimum peening condition determined based on only saturation time is long. According to the present embodiment, the optimum peening condition is determined such that a short coverage time is certainly attained.

Note that the optimum peening condition may be determined based on only coverage time without determining the optimum peening condition based on saturation time.

The shot-peening processing methods according to the above embodiments can be applied to a method for manufacturing metal part.

The present invention has been described with reference to the embodiments; however, the present invention is not limited to the above embodiments. Various modifications can be applied to the above embodiments.

This application is based upon and claims the benefit of priority from Japanese Patent Application No. 2009-050673, filed on Mar. 4, 2009, the disclosure of which is incorporated herein in its entirely by reference.

The invention claimed is:

1. A method for setting a shot peening process condition comprising:

obtaining, for each of a plurality of peening conditions for a first combination as a combination of a shot peening processing apparatus and media, a saturation time based on a saturation curve indicating a change in an arc height value of an Almen strip with respect to a projection time, each of said plurality of peening conditions specifying values of condition factors;

determining optimum values of said condition factors of a first optimum peening condition corresponding to said first combination from said plurality of peening conditions based on said saturation time; and determining a spot movement condition based on a relation between a projection time of said media and an area or a width of a region of a test piece, where a dimpled area rate is saturated, wherein said condition factors of said plurality of peening conditions include:

a first condition factor; and a second condition factor;

wherein said plurality of peening conditions includes:

a first peening condition;

a second peening condition different from said first peening condition in only said value of said first condition factor;

a third peening condition; and a fourth peening condition different from said third peening condition in only said value of said second condition factor;

wherein said determining said optimum values of said condition factors of said first optimum peening condition based on said saturation time includes:

determining said optimum value of said first condition factor in said first optimum peening condition based on a first saturation time under said first peening condition and a second saturation time under said second peening condition; and determining said optimum value of said second condition factor in said first optimum peening condition based on a third saturation time under said third peening condition and a fourth saturation time under said fourth peening condition;

wherein said shot peening processing apparatus projects said media from a nozzle by using air; and wherein said first condition factor and said second condition factor are two of a flow rate of said media, a pressure of said air, an inner diameter of said nozzle, and a movement speed of said nozzle.

2. The method for setting said shot peening process condition according to claim 1, wherein said determining said spot movement condition comprises:

said media to said test piece under said first optimum peening condition by said shot peening processing apparatus;

obtaining a relation between a distribution of said dimpled area rate in said test piece and said projection time; and obtaining, based on said relation between said distribution of said dimpled area rate and said projection time, a relation between said area or said width of said region of said test piece, in which said dimpled area rate is saturated, and said projection time, wherein said dimpled area rate indicates an area occupied by dimples formed by said media per unit area.

3. The method for setting said shot peening process condition according to claim 2, wherein said determining said spot movement condition further comprises:

determining said spot movement condition based on said relation between said area or said width of said region of said test piece and said projection time, wherein said spot movement condition indicates a pitch of movement trajectories along which a spot moves, wherein said movement trajectories are parallel to each other, and wherein said spot is a region of a work, which is hit by said media when said shot peening processing apparatus processes said work.

4. The method for setting said shot peening process condition according to claim 1, further comprising, when an intensity corresponding to said first optimum peening condition does not match an intensity required for a work:

obtaining a saturation time for each of a plurality of peening conditions for a second combination as a combination of said shot peening processing apparatus and said media; and determining a second optimum peening condition corresponding to said second combination based on said saturation time for each of said plurality of peening conditions for said second combination.

5. The method for setting said shot peening process condition according to claim 1, further comprising obtaining an intensity under said first optimum peening condition.

6. The method for setting said shot peening process condition according to claim 1, further comprising:

obtaining a coverage time as a projection time required for a coverage of 100% for each of said plurality of peening conditions by using said Almen strip used in said obtaining said saturation time;

determining a third optimum peening condition corresponding to said first combination based on said coverage time; and determining said fourth peening condition based on said first peening condition and said third peening condition.

7. A method for manufacturing a metal part comprising:

determining a shot peening process condition; and processing a work based on said shot peening process condition, wherein said determining said shot peening process condition includes:

obtaining, for each of a plurality of peening conditions for a first combination as a combination of a shot peening processing apparatus and media, a saturation time based on a saturation curve indicating a change in an arc height value of an Almen strip with respect to a projection time, each of said plurality of peening conditions specifying values of condition factors;

determining optimum values of said condition factors of a first optimum peening condition corresponding to said first combination from said plurality of peening conditions based on said saturation time; and determining a spot movement condition based on a relation between a projection time of said media and an area or a width of a region of a test piece, where a dimpled area rate is saturated, wherein said condition factors of said plurality of peening conditions include a first condition factor and a second condition factor;

wherein said plurality of peening conditions includes:

a first peening condition;

a second peening condition different from said first peening condition in only said value of said first condition factor;

a third peening condition; and a fourth peening condition different from said third peening condition in only said value of said second condition factor;

wherein said determining said optimum values of said condition factors of said first optimum peening condition based on said saturation time includes:

determining said optimum value of said first condition factor in said first optimum peening condition based on a first saturation time under said first peening condition and a second saturation time under said second peening condition; and determining said optimum value of said second condition factor in said first optimum peening condition based on a third saturation time under said third peening condition and a fourth saturation time under said fourth peening condition;

wherein said shot peening processing apparatus projects said media from a nozzle by using air; and wherein said first condition factor and said second condition factor are two of a flow rate of said media, a pressure of said air, an inner diameter of said nozzle, and a movement speed of said nozzle.

8. The method for manufacturing said metal part according to claim 7, wherein said determining said spot movement condition comprises:

projecting said media to said test piece under said first optimum peening condition by said shot peening processing apparatus;

obtaining a relation between a distribution of said dimpled area rate in said test piece and said projection time; and obtaining, based on said relation between said distribution of said dimpled area rate and said projection time, a relation between said area or said width of said region of said test piece, in which said dimpled area rate is saturated, and said projection time, wherein said dimpled area rate indicates an area occupied by dimples formed by said media per unit area.

9. The method for manufacturing said metal part according to claim 8, wherein said determining said spot movement condition further comprises:

determining said spot movement condition based on said relation between said area or said width of said region of said test piece and said projection time, wherein said spot movement condition indicates a pitch of movement trajectories of a spot as a region of said work which is hit by said media when said shot peening processing apparatus processes said work, and wherein said movement trajectories are parallel to each other.

10. The method for manufacturing said metal part according to claim 7, further comprising, when an intensity corresponding to said first optimum peening condition does not match an intensity required for a said work:

obtaining a saturation time for each of a plurality of peening conditions for a second combination as a combination of said shot peening processing apparatus and said media; and determining a second optimum peening condition corresponding to said second combination based on said saturation time corresponding to said second combination.

11. The method for manufacturing said metal part according to claim 7, further comprising obtaining an intensity under said first optimum peening condition.

12. The method for manufacturing said metal part according to claim 7, further comprising:

obtaining a coverage time as a projection time required for a coverage of 100% for each of said plurality of peening conditions by using said Almen strip used in said obtaining said saturation time;

determining a third optimum peening condition corresponding to said first combination based on said coverage time; and determining said fourth peening condition based on said first peening condition and said third optimum peening condition.

13. A method for setting a shot peening process condition comprising:

obtaining, for each of a plurality of peening conditions for a first combination as a combination of a shot peening processing apparatus and media, a saturation time based on a saturation curve indicating a change in an arc height value of an Almen strip with respect to a projection time, each of said plurality of peening conditions specifying values of condition factors;

determining optimum values of said condition factors of a first optimum peening condition corresponding to said first combination from said plurality of peening conditions based on said saturation time; and determining a spot movement condition based on a relation between a projection time of said media and an area or a width of a region of a test piece, where a dimpled area rate is saturated, wherein said condition factors of said plurality of peening conditions include:

a first condition factor; and a second condition factor;

wherein said plurality of peening conditions includes:

a first peening condition;

a second peening condition different from said first peening condition in only said value of said first condition factor;

a third peening condition; and a fourth peening condition different from said third peening condition in only said value of said second condition factor;

wherein said determining said optimum values of said condition factors of said first optimum peening condition based on said saturation time includes:

determining said optimum value of said first condition factor in said first optimum peening condition based on a first saturation time under said first peening condition and a second saturation time under said second peening condition; and determining said optimum value of said second condition factor in said first optimum peening condition based on a third saturation time under said third peening condition and a fourth saturation time under said fourth peening condition; and wherein said shot peening processing apparatus projects said media by using an impeller; and wherein said first condition factor and said second condition factor are two of a rotation speed of said impeller, a distance between said impeller and a surface to be processed, an angle between said impeller and said surface to be processed, a size of a projection outlet, a movement speed of a work, and a rotation speed of said work.

14. The method for setting said shot peening process condition according to claim 13, wherein said determining said spot movement condition comprises:

projecting said media to said test piece under said first optimum peening condition by said shot peening processing apparatus;

obtaining a relation between a distribution of said dimpled area rate in said test piece and said projection time; and obtaining, based on said relation between said distribution of said dimpled area rate and said projection time, a relation between said area or said width of said region of said test piece, in which said dimpled area rate is saturated, and said projection time, wherein said dimpled area rate indicates an area occupied by dimples formed by said media per unit area.

15. The method for setting said shot peening process condition according to claim 14, wherein said determining said spot movement condition further comprises:

determining said spot movement condition based on said relation between said area or said width of said region of said test piece and said projection time, wherein said spot movement condition indicates a pitch of movement trajectories along which a spot moves, wherein said movement trajectories are parallel to each other, and wherein said spot is a region of said work, which is hit by said media when said shot peening processing apparatus processes said work.

16. The method for setting said shot peening process condition according to claim 13, further comprising, when an intensity corresponding to said first optimum peening condition does not match an intensity required for said work:

obtaining a saturation time for each of a plurality of peening conditions for a second combination as a combination of said shot peening processing apparatus and said media; and determining a second optimum peening condition corresponding to said second combination based on said saturation time for each of said plurality of peening conditions for said second combination.

17. The method for setting said shot peening process condition according to claim 13, further comprising obtaining an intensity under said first optimum peening condition.

18. The method for setting said shot peening process condition according to claim 13, further comprising:

obtaining a coverage time as a projection time required for a coverage of 100% for each of said plurality of peening conditions by using said Almen strip used in said obtaining said saturation time;

determining a third optimum peening condition corresponding to said first combination based on said coverage time; and determining said fourth peening condition based on said first peening condition and said third peening condition.

19. A method for manufacturing a metal part comprising:

determining a shot peening process condition; and processing a work based on said shot peening process condition, wherein said determining said shot peening process condition includes:

obtaining, for each of a plurality of peening conditions for a first combination as a combination of a shot peening processing apparatus and media, a saturation time based on a saturation curve indicating a change in an arc height value of an Almen strip with respect to a projection time, each of said plurality of peening conditions specifying values of condition factors;

determining optimum values of said condition factors of a first optimum peening condition corresponding to said first combination from said plurality of peening conditions based on said saturation time; and determining a spot movement condition based on a relation between a projection time of said media and an area or a width of a region of a test piece, where a dimpled area rate is saturated, wherein said condition factors of said plurality of peening conditions include a first condition factor and a second condition factor;

wherein said plurality of peening conditions includes:

a first peening condition;

a second peening condition different from said first peening condition in only said value of said first condition factor;

a third peening condition; and a fourth peening condition different from said third peening condition in only said value of said second condition factor;

wherein said determining said optimum values of said condition factors of said first optimum peening condition based on said saturation time includes:

determining said optimum value of said first condition factor in said first optimum peening condition based on a first saturation time under first peening condition and a second saturation time under said second peening condition; and determining said optimum value of said second condition factor in said first optimum peening condition based on a third saturation time under said third peening condition and a fourth saturation time under said fourth peening condition;

wherein said shot peening processing apparatus projects said media by using an impeller; and wherein said first condition factor and said second condition factor are two of a rotation speed of said impeller, a distance between said impeller and a surface to be processed, an angle between said impeller and said surface to be processed, a size of a projection outlet, a movement speed of said work, and a rotation speed of said work.

20. The method for manufacturing said metal part according to claim 19, wherein said determining said spot movement condition comprises:

projecting said media to said test piece under said first optimum peening condition by said shot peening processing apparatus;

obtaining a relation between a distribution of said dimpled area rate in said test piece and said projection time; and obtaining, based on said relation between said distribution of said dimpled area rate and said projection time, a relation between said area or said width of said region of said test piece, in which said dimpled area rate is saturated, and said projection time, wherein said dimpled area rate indicates an area occupied by dimples formed by said media per unit area.

21. The method for manufacturing said metal part according to claim 20, wherein said determining said spot movement condition further comprises:

determining said spot movement condition based on said relation between said area or said width of said region of said test piece and said projection time, wherein said spot movement condition indicates a pitch of movement trajectories of a spot as a region of said work which is hit by said media when said shot peening processing apparatus processes said work, and wherein said movement trajectories are parallel to each other.

22. The method for manufacturing said metal part according to claim 19, further comprising, when an intensity corresponding to said first optimum peening condition does not match an intensity required for said work:

obtaining a saturation time for each of a plurality of peening conditions for a second combination as a combination of said shot peening processing apparatus and said media; and determining a second optimum peening condition corresponding to said second combination based on said saturation time corresponding to said second combination.

23. The method for manufacturing said metal part according to claim 19, further comprising obtaining an intensity under said first optimum peening condition.

24. The method for manufacturing said metal part according to claim 19, further comprising:

obtaining a coverage time as a projection time required for a coverage of 100% for each of said plurality of peening conditions by using said Almen strip used in said obtaining said saturation time;

determining a third optimum peening condition corresponding to said first combination based on said coverage time; and determining said fourth peening condition based on said first peening condition and said third optimum peening condition.

* * * * *